US011549317B2

(12) United States Patent
Netecke et al.

(10) Patent No.: US 11,549,317 B2
(45) Date of Patent: Jan. 10, 2023

(54) DRAWWORKS APPARATUS AND METHOD

(71) Applicant: Cameron International Corporation, Houston, TX (US)

(72) Inventors: Mike Netecke, Spring, TX (US); Roy Cabrera, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 52 days.

(21) Appl. No.: 17/001,875

(22) Filed: Aug. 25, 2020

(65) Prior Publication Data

US 2020/0386061 A1 Dec. 10, 2020

Related U.S. Application Data

(63) Continuation of application No. 15/259,885, filed on Sep. 8, 2016, now Pat. No. 10,982,495.

(51) Int. Cl.
*E21B 19/00* (2006.01)
*B65H 75/14* (2006.01)

(52) U.S. Cl.
CPC ..... *E21B 19/008* (2013.01); *B65H 75/14* (2013.01)

(58) Field of Classification Search
CPC ..... B66D 1/14; B65H 75/14; E21B 19/008; E21B 19/084; F16B 3/06
See application file for complete search history.

(56) References Cited

U.S. PATENT DOCUMENTS

| | | | | |
|---|---|---|---|---|
| 1,487,086 | A | 3/1924 | Bruner | |
| 1,660,271 | A | 2/1928 | Miller | |
| 1,803,231 | A | 4/1931 | Camblin | |
| 1,804,585 | A | 5/1931 | Barner | |
| 1,949,553 | A | 3/1934 | Tremolada | |
| 3,985,047 | A | 10/1976 | Therkelsen | |
| 9,010,551 | B2 | 4/2015 | Nero et al. | |
| 2010/0226715 | A1* | 9/2010 | Schneider | F16B 3/06 403/350 |
| 2014/0112732 | A1* | 4/2014 | Bushen | F16B 3/06 411/55 |
| 2014/0284108 | A1 | 9/2014 | Pendleton et al. | |
| 2018/0066482 | A1 | 3/2018 | Netecke et al. | |

* cited by examiner

*Primary Examiner* — Sang K Kim
*Assistant Examiner* — Nathaniel L Adams
(74) *Attorney, Agent, or Firm* — Kelly McKinney

(57) ABSTRACT

A drawworks assembly including a drum including a first end, a second end, and a longitudinal axis, a coupling assembly configured to transmit torque to the drum, and a cradle assembly configured to support the drum, wherein the coupling assembly is releasably coupled to the drum at a first planar engagement interface disposed at the first end of the drum, wherein the cradle assembly is releasably coupled to the drum at a second planar engagement interface disposed at the second end of the drum.

6 Claims, 16 Drawing Sheets

DRAWWORKS APPARATUS AND METHOD

This application is a continuation application of U.S. application Ser. No. 15/529,885 with the same title filed on Sep. 8, 2016 which is incorporated by reference herein in its entirety.

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Hydrocarbon drilling systems utilize drilling fluid or mud for drilling a wellbore in a subterranean earthen formation. In some applications, drilling systems include a drawworks for controlling the displacement of a drillstring of the drilling system into and out of the wellbore. Particularly, the drawworks is configured to control the displacement of a drilling line of the drilling system that helps support the drillstring via a travelling block coupled to the drilling line, where the drillstring is suspended from the travelling block via a hook coupled to the travelling block. The drilling line is reeled over a stationary crown block forming a "block and tackle" arrangement to provide mechanical advantage in manipulating the drillstring. In some applications, the drawworks includes a drum about which the drilling line is spooled, where the drum is powered by one or more electric motors that supply the drum with torque via a gearbox coupled between the drum and one or more electric motors. In some applications, the drum includes one or more disk brakes or clutches to provide braking and positional control of the drum. In certain applications, the gearbox of the drawworks is coupled to the drum by a rotational shaft that extends into the drum, where torque is transferred between the gearbox and drum via the rotational shaft.

SUMMARY

An embodiment of a drum for a drawworks assembly comprises a drum body comprising a first end, a second end, and a longitudinal axis, a first planar engagement surface disposed at the first end of the drum body, and a second planar engagement surface disposed at the second end of the drum body, wherein both the first and second engagement surfaces comprise a plurality of circumferentially spaced first apertures, the first apertures configured to receive a plurality of fasteners configured to releasably couple the drum to the drawworks assembly, wherein the first and second engagement surfaces comprise a plurality of circumferentially spaced second apertures, the second apertures configured to receive a plurality of pin assemblies configured to transmit torque between the drum and a driveshaft of the drawworks assembly. In some embodiments, the first and second engagement surfaces comprise annular engagement surfaces. In some embodiments, the first planar engagement surface of the drum is configured to releasably couple with a planar engagement surface of a coupling assembly of the drawworks assembly. In certain embodiments, the plurality of fasteners are configured to extend through a plurality of circumferentially spaced first apertures disposed in the engagement surface of the coupling assembly and threadably engage the first apertures of the first engagement surface to releasably couple the coupling assembly with the drum body. In certain embodiments, the plurality of pin assemblies are configured to extend through both a plurality of circumferentially spaced second apertures disposed in the engagement surface of the coupling assembly and the plurality of second apertures of the first engagement surface to provide for the transmission of torque between the coupling assembly and the drum body. In some embodiments, the second planar engagement surface of the drum is configured to releasably couple with a planar engagement surface of a cradle assembly of the drawworks assembly. In some embodiments, the plurality of fasteners are configured to extend through a plurality of circumferentially spaced first apertures disposed in the engagement surface of the cradle assembly and threadably engage the first apertures of the second engagement surface to releasably couple the cradle assembly with the drum body. In certain embodiments, the plurality of second apertures each comprise a diameter this greater than a diameter of each of the plurality of first apertures.

An embodiment of a drawworks assembly comprises a drum comprising a first end, a second end, and a longitudinal axis, a coupling assembly configured to transmit torque to the drum, and a cradle assembly configured to support the drum, wherein the coupling assembly is releasably coupled to the drum at a first planar engagement interface disposed at the first end of the drum, wherein the cradle assembly is releasably coupled to the drum at a second planar engagement interface disposed at the second end of the drum. In some embodiments, the first engagement interface and the second engagement interface are both disposed substantially orthogonal to the longitudinal axis of the drum. In some embodiments, the first end of the drum comprises a first planar engagement surface comprising a plurality of circumferentially spaced first apertures and a plurality of circumferentially spaced second apertures. In certain embodiments, the drawworks assembly further comprises a plurality of circumferentially spaced fasteners extending through a hub of the coupling assembly, wherein each fastener threadably engages one of the plurality of first apertures to releasably couple the coupling assembly with the drum. In certain embodiments, the drawworks assembly further comprises a plurality of circumferentially spaced pin assemblies extending through a hub of the coupling assembly, wherein each pin assembly is disposed in one of the plurality of second apertures to provide for the transmission of torque between the coupling assembly and the drum. In some embodiments, each pin assembly comprises an outer sleeve comprising a first end, a second end, and a bore extending between the first and second ends, a pin disposed in the bore of the outer sleeve, wherein the pin comprises a an outer surface having a diameter that varies across the longitudinal length of the pin, and a threaded fastener extending into an aperture of the pin, wherein rotation of the threaded fastener is configured to longitudinally displace the pin through the bore of the outer sleeve and adjust a diameter of an outer surface of the sleeve. In some embodiments, a diameter of each pin assembly is greater than a diameter of each fastener. In certain embodiments, the drum comprises a bore extending between the first and second ends of the drum, and neither the coupling assembly nor the cradle assembly extend into the bore of the drum.

An embodiment of a method of manipulating a drum of a drawworks assembly comprises removing a first plurality of fasteners releasably coupling a drum with a coupling assembly, removing a second plurality of fasteners releasably coupling the drum with a cradle assembly, and lifting the drum vertically from the drawworks assembly. In some embodiments, as the drum is lifted vertically from the drawworks assembly, a longitudinal axis of the drum remains substantially parallel with a longitudinal axis of the drawworks assembly. In some embodiments, as the drum is lifted vertically from the drawworks assembly, the coupling assembly and the cradle assembly are disposed stationary on a frame of the drawworks assembly. In certain embodiments, the method further comprises vertically lowering the drum until a longitudinal axis of the drum is aligned with a longitudinal axis of the drawworks assembly, inserting the first plurality of fasteners into a plurality of circumferentially spaced apertures disposed in a first planar engagement surface of the drum to releasably couple the coupling assembly with the drum, and inserting the second plurality of fasteners into a plurality of circumferentially spaced apertures disposed in a second planar engagement surface of the drum to releasably couple the cradle assembly with the drum.

BRIEF DESCRIPTION OF THE DRAWINGS

For a detailed description of exemplary embodiments, reference will now be made to the accompanying drawings in which.

DETAILED DESCRIPTION

Figure 1:
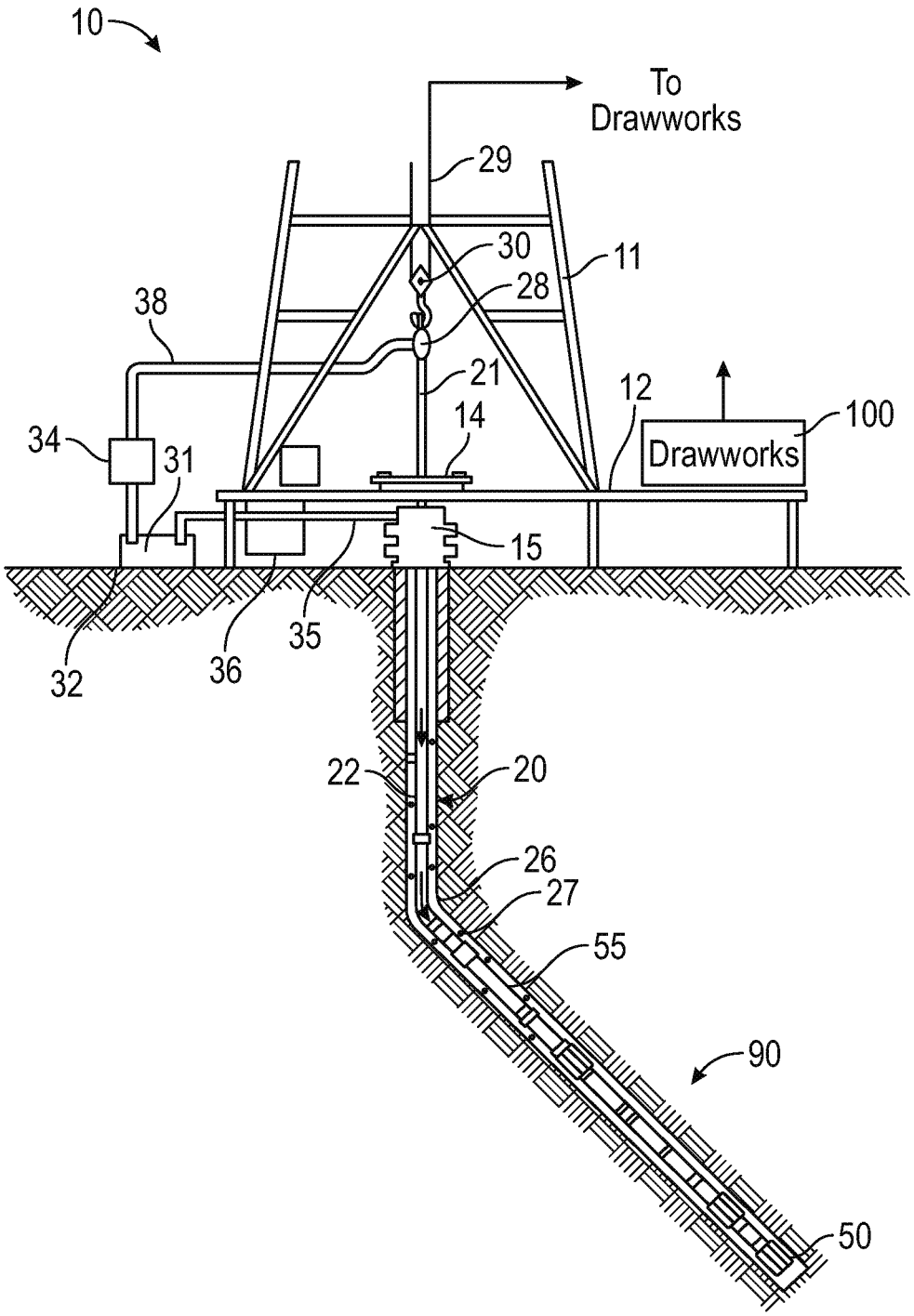
FIG. 1 is a schematic view of an embodiment of a drilling system in accordance with principles disclosed herein.

In the drawings and description that follow, like parts are typically marked throughout the specification and drawings with the same reference numerals. The drawing figures are not necessarily to scale. Certain features of the disclosed embodiments may be shown exaggerated in scale or in somewhat schematic form and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the disclosure, and is not intended to limit the disclosure to that illustrated and described herein. It is to be fully recognized that the different teachings of the embodiments discussed below may be employed separately or in any suitable combination to produce desired results.

Unless otherwise specified, in the following discussion and in the claims, the terms "including" and "comprising" are used in an open-ended fashion, and thus should be interpreted to mean "including, but not limited to . . . ". Any use of any form of the terms "connect", "engage", "couple", "attach", or any other term describing an interaction between elements is not meant to limit the interaction to direct interaction between the elements and may also include indirect interaction between the elements described. The various characteristics mentioned above, as well as other features and characteristics described in more detail below, will be readily apparent to those skilled in the art upon reading the following detailed description of the embodiments, and by referring to the accompanying drawings.

Referring now to FIG. 1, a schematic diagram of an embodiment of a drilling system 10 in accordance with the principles described herein is shown. Drilling system 10 includes a drilling assembly 90 for drilling a borehole 26. In addition, drilling system 10 includes a derrick 11 having a floor 12, which supports a rotary table 14 that is rotated by a prime mover such as an electric motor (not shown) at a desired rotational speed and controlled by a motor controller (not shown). In other embodiments, the rotary table (e.g., rotary table 14) may be augmented or replaced by a top drive suspended in the derrick (e.g., derrick 11) and connected to the drillstring (e.g., drillstring 20).

Drilling assembly 90 comprises a drillstring 20 including a drill pipe 22 extending downward from the rotary table 14 through a pressure control device 15 into the borehole 26. The pressure control device 15 is commonly hydraulically powered and may contain sensors for detecting certain operating parameters and controlling the actuation of the pressure control device 15. A drill bit 50, attached to the lower end of drillstring 20, disintegrates the earthen formations when it is rotated with weight-on-bit (WOB) to drill the borehole 26. Drillstring 20 is coupled to a drawworks assembly 100 via a kelly joint 21, swivel 28, and drilling line 29 through a travelling block 30. In this arrangement, drawworks 100 may be actuated to reel in or out drilling line 29, which acts to raise or lower travelling block 30. During drilling operations, drawworks 100 is operated to control the WOB, which impacts the rate-of-penetration of drill bit 50 through the formation. In this embodiment, drill bit 50 may be rotated from the surface by drillstring 20 via rotary table 14 and/or a top drive, rotated by downhole mud motor 55 disposed in drilling assembly 90, or combinations thereof (e.g., rotated by both rotary table 14 via drillstring 20 and mud motor 55, rotated by a top drive and the mud motor 55, etc.). For example, rotation via downhole motor 55 may be employed to supplement the rotational power of rotary table 14, if required, and/or to effect changes in the drilling process. In either case, the rate-of-penetration (ROP) of the drill bit 50 into the borehole 26 for a given formation and a drilling assembly largely depends upon the weight-on-bit and the drill bit rotational speed. Further, while in this embodiment drawworks 100 is used in drilling system 10, in other embodiments drawworks 100 may be used in other drilling systems, including offshore drilling systems.

During drilling operations a suitable drilling fluid 31 is pumped under pressure from a mud tank 32 through the drillstring 20 by a mud pump 34. Drilling fluid 31 passes from the mud pump 34 into the drillstring 20 via a fluid line 38, and the kelly joint 21. Drilling fluid 31 is discharged at the borehole bottom through nozzles in face of drill bit 50, circulates to the surface through an annular space 27 radially positioned between drillstring 20 and the sidewall of borehole 26, and then returns to mud tank 32 via a solids control system 36 and a return line 35. Solids control system 36 may include any suitable solids control equipment known in the art including, without limitation, shale shakers, centrifuges, and automated chemical additive systems. Control system 36 may include sensors and automated controls for monitoring and controlling, respectively, various operating parameters such as centrifuge rpm. It should be appreciated that much of the surface equipment for handling the drilling fluid is application specific and may vary on a case-by-case basis.

Figure 2:
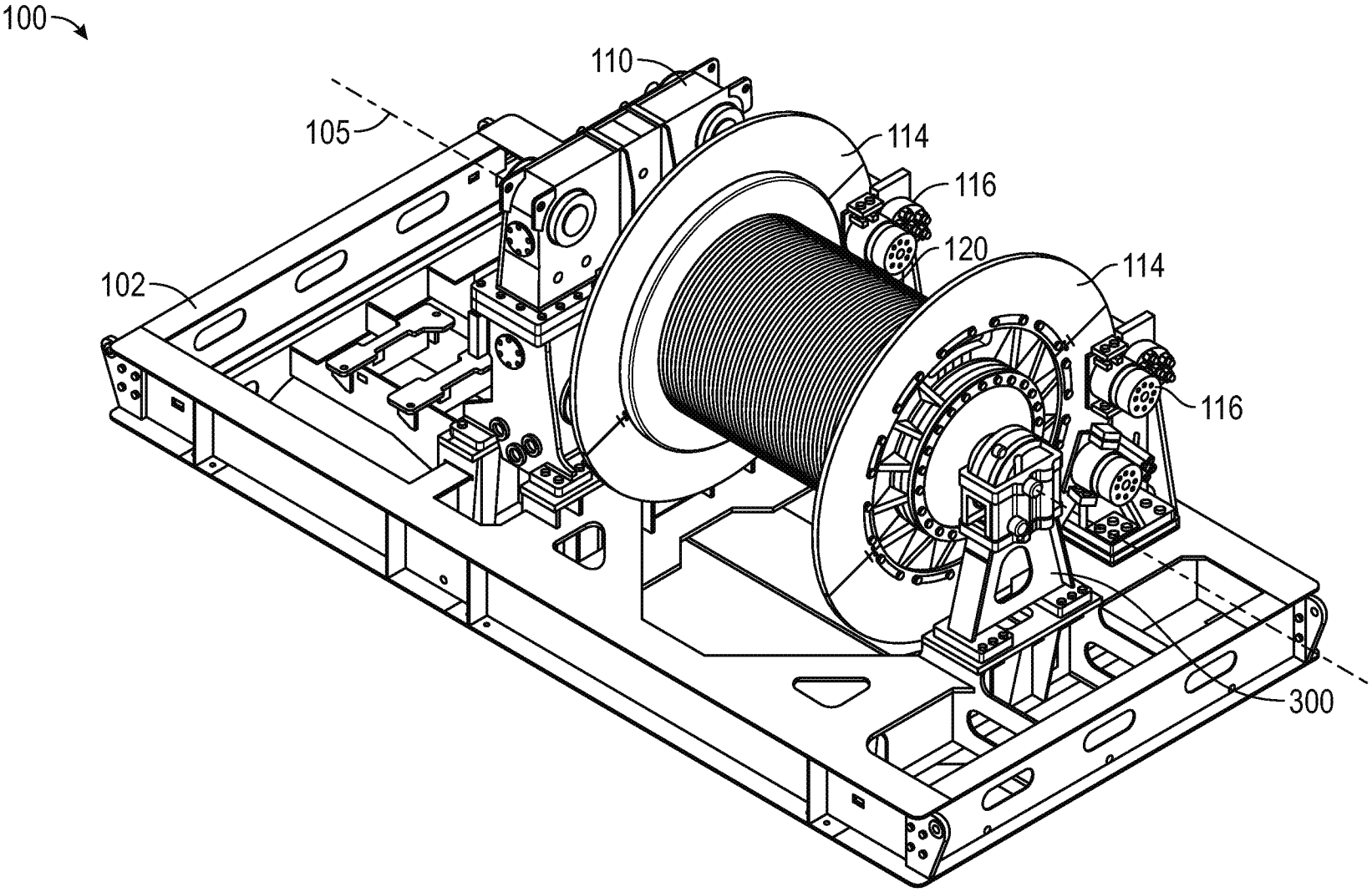
FIG. 2 is a first perspective view of an embodiment of a drawworks assembly of the drilling system shown in FIG. 1 in accordance with principles disclosed herein.
Figure 3:
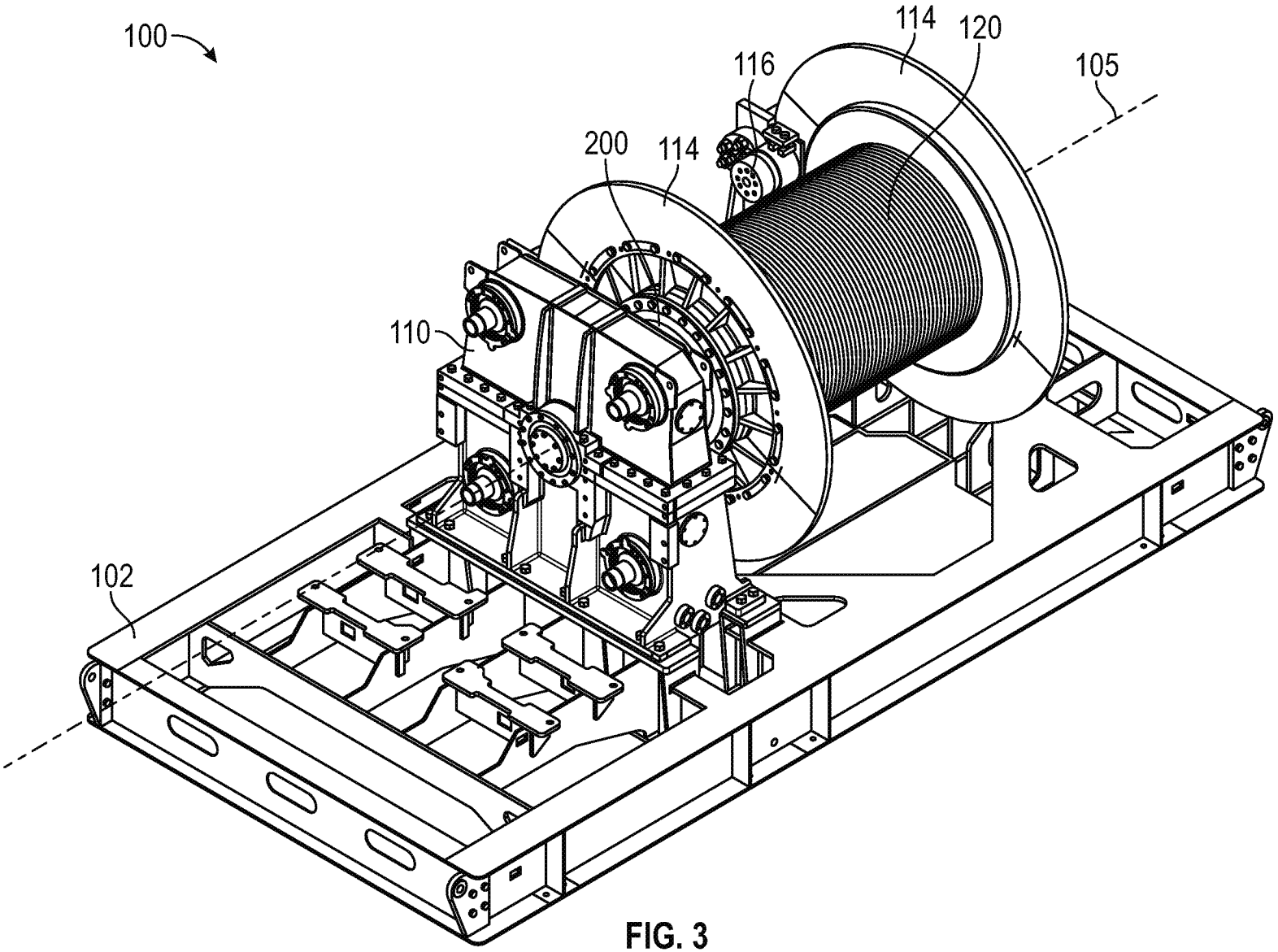
FIG. 3 is a second perspective view of the drawworks assembly shown in FIG. 2.
Figure 4:
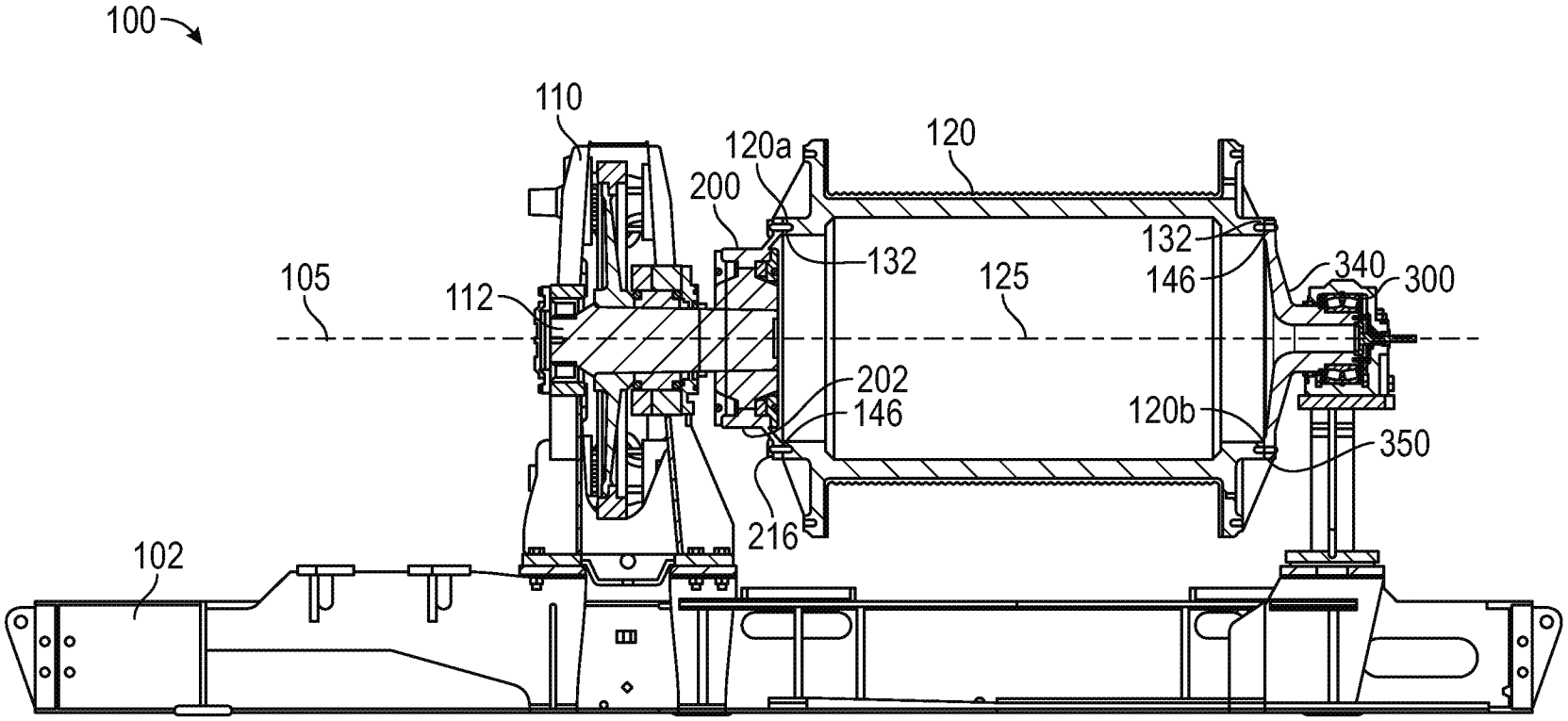
FIG. 4 is a side cross-sectional view of the drawworks assembly of FIG. 2 shown in a first position.

Referring to FIGS. 2-4, views of an embodiment of drawworks assembly 100 are shown. In this embodiment, drawworks 100 generally includes a central or longitudinal axis 105, a skid or support frame 102, a transmission or gearbox 110, a drum or drum body 120, a coupling or spherical coupling assembly 200, and a cradle assembly 300. Support frame 102 is disposed on floor 12 of derrick 11 (shown in FIG. 1) and is configured to physically support the components of drawworks 100 and to transmit operational loads of drawworks 100 to the substructure of floor 12. Drawworks 100 additionally includes one or more motors or power sources (not shown) configured to generate and provide rotational torque to a driveshaft 112 of gearbox 110. In certain embodiments, the one or more motors comprise electric motors, while in other embodiments the one or more motors may comprise diesel engines. Gearbox 110 is configured to receive rotational torque from the one or more motors and provide a desired rotational speed and/or mechanical advantage to driveshaft 112 via one or more gears disposed therein.

Spherical coupling assembly 200 is coupled between gearbox 110 and drum 120 and is generally configured to transmit rotational torque received from gearbox 110 (via driveshaft 112) to drum 120. While drawworks assembly 100 is shown as including spherical coupling assembly 200, in other embodiments, drawworks 100 may comprise other components configured to transmit torque between drum 120 and gearbox 110. In this embodiment, spherical coupling assembly 200 is configured to transmit rotational torque between driveshaft 112 of gearbox 110 and drum 120 even when a longitudinal axis of driveshaft 112 and a longitudinal axis of drum 120 are angularly misaligned. In this manner, drum 120 may be rotated about its longitudinal axis via torque transmitted from gearbox 110 and spherical coupling assembly 200. Cradle 300 is coupled between drum 120 and support frame 102 and is configured to physically support drum 120. As will be described further herein, cradle 300 includes a bearing assembly configured to provide a rotational coupling between drum 120 and cradle 300 to allow for relative rotation between drum 120 and stationary components of cradle 300. In this arrangement, spherical coupling assembly 200 and cradle 300 provide for physical support of drum 120 at each longitudinal end of drum 120.

In the embodiment shown in FIGS. 2-4, drawworks assembly 100 additionally includes a pair of disk brakes 114, with one disk brake 114 coupled to each longitudinal end of drum 120 such that drum 120 and brakes 114 rotate in concert. In the embodiment shown, each disk brake 114 comprises a pair of arcuate sections extending approximately 180°; however, in other embodiments each disk brake 114 may comprise a single annular member. Drawworks 100 further includes a pair of caliper assemblies 116, where each caliber assembly 116 is positioned proximal a corresponding disk brake 114 to provide for selectable frictional engagement between a brake pad (not shown) of the caliber assembly 116 and the corresponding disk brake 114 to control the rotation of drum 120 about its longitudinal axis. Although in the embodiment shown in FIGS. 2-4 drawworks 100 includes disk brakes 114 and associated caliper assemblies 116, in other embodiments drawworks 100 may include other mechanisms for providing braking of drum 120 or otherwise controlling the rotation or rotational position of drum 120.

Figure 5:
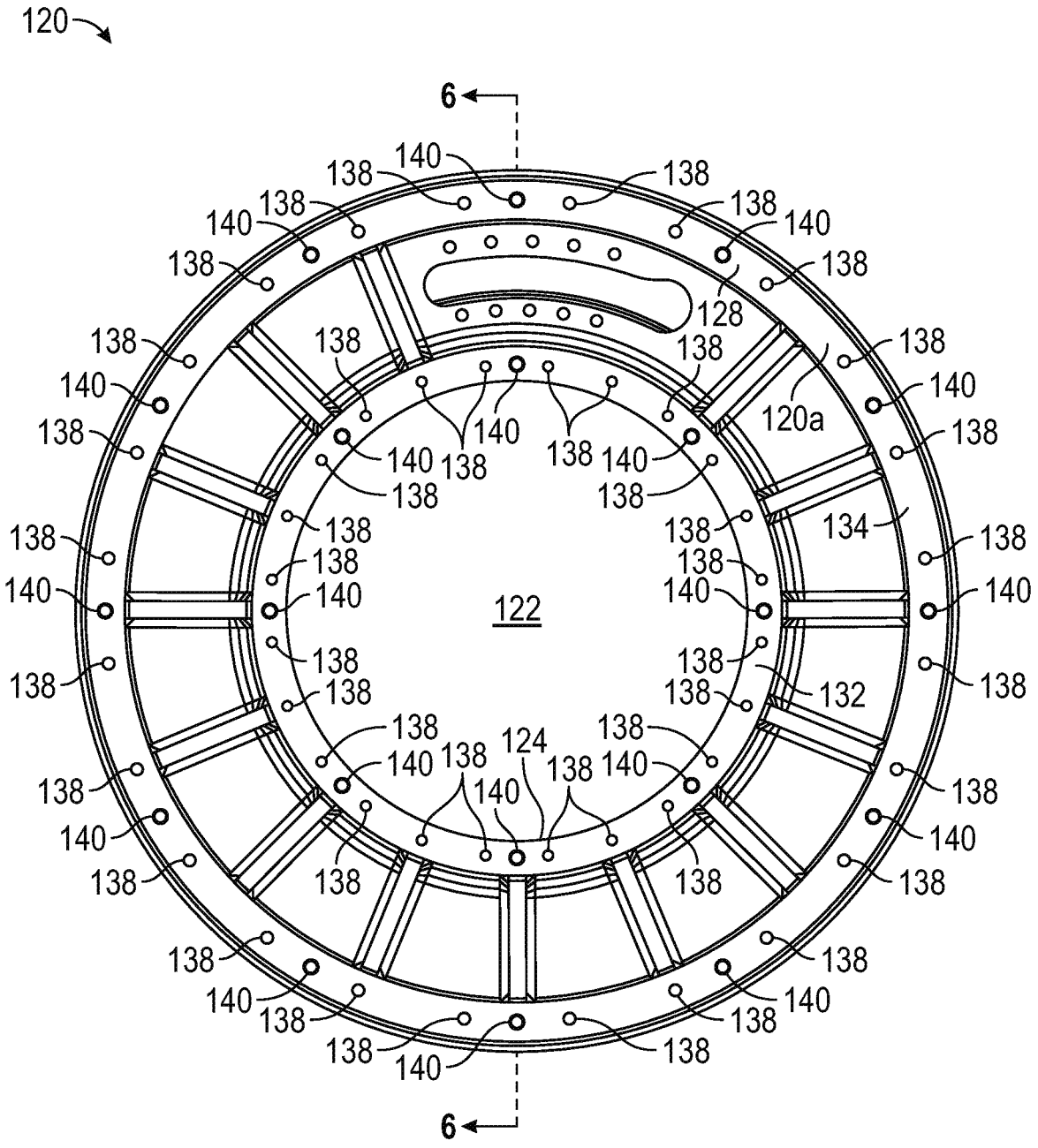
FIG. 5 is a side view of an embodiment of a drum of the drawworks assembly shown in FIG. 2 in accordance with principles disclosed herein.
Figure 6:
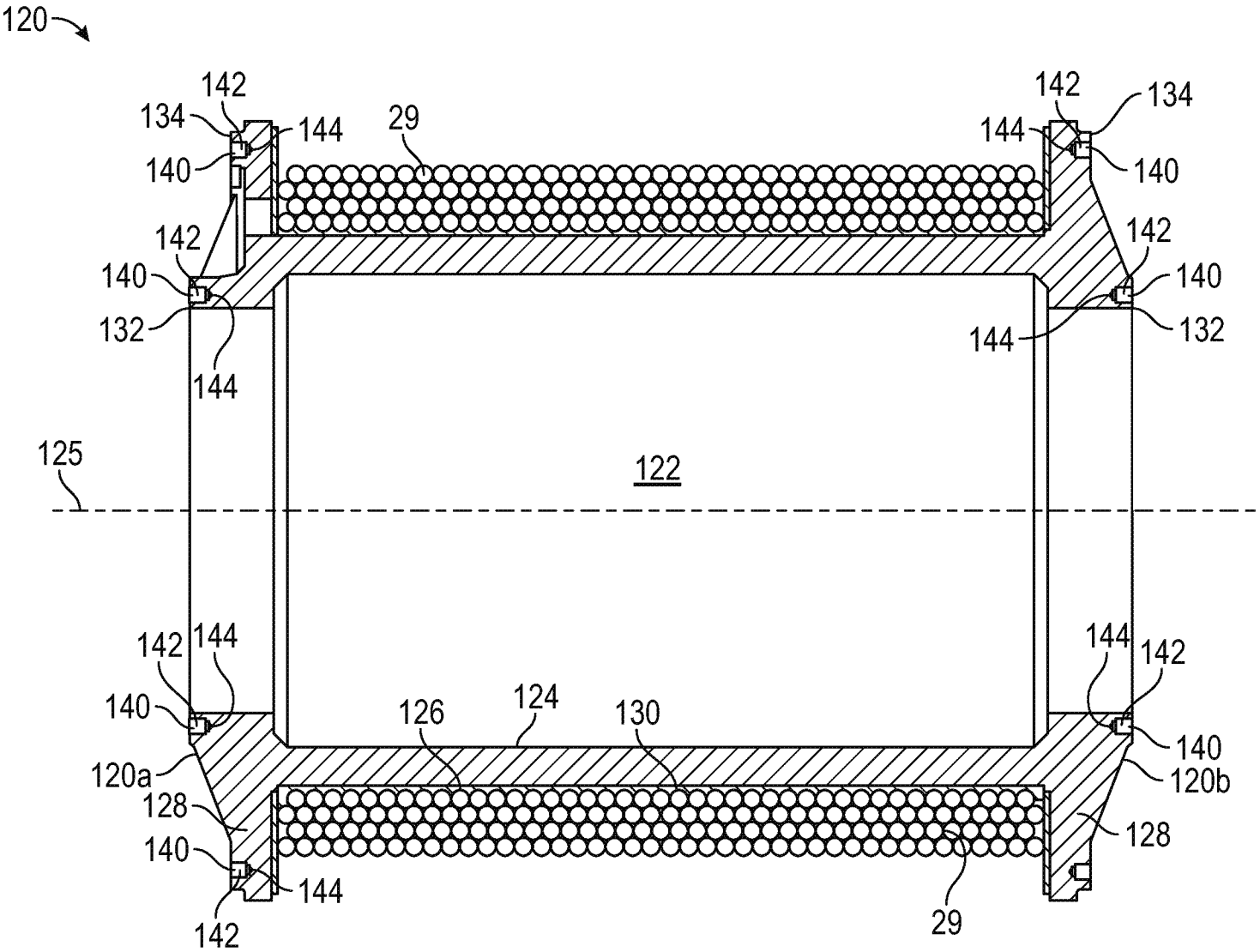
FIG. 6 is a cross-sectional view alone line 6-6 of FIG. 5 of the drum shown in FIG. 5.
Figure 7:
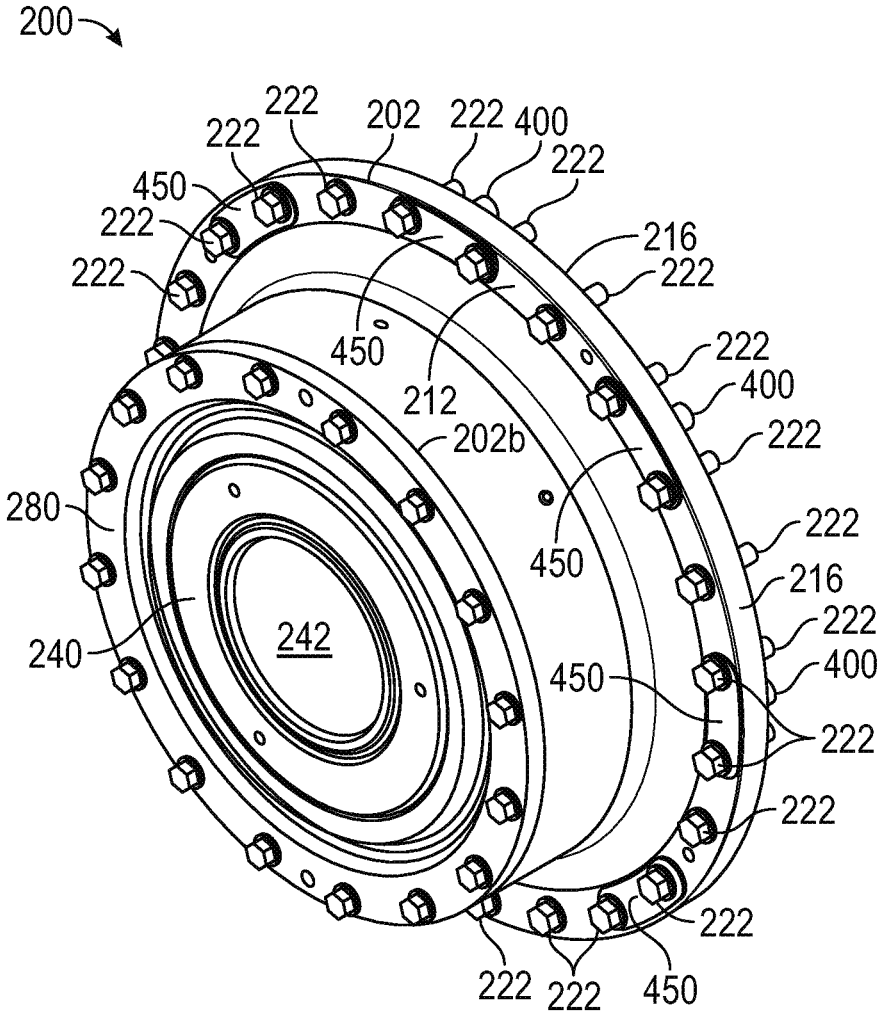
FIG. 7 is a perspective view of an embodiment of a spherical coupling assembly of the drawworks assembly shown in FIG. 2 in accordance with principles disclosed herein.
Figure 8:
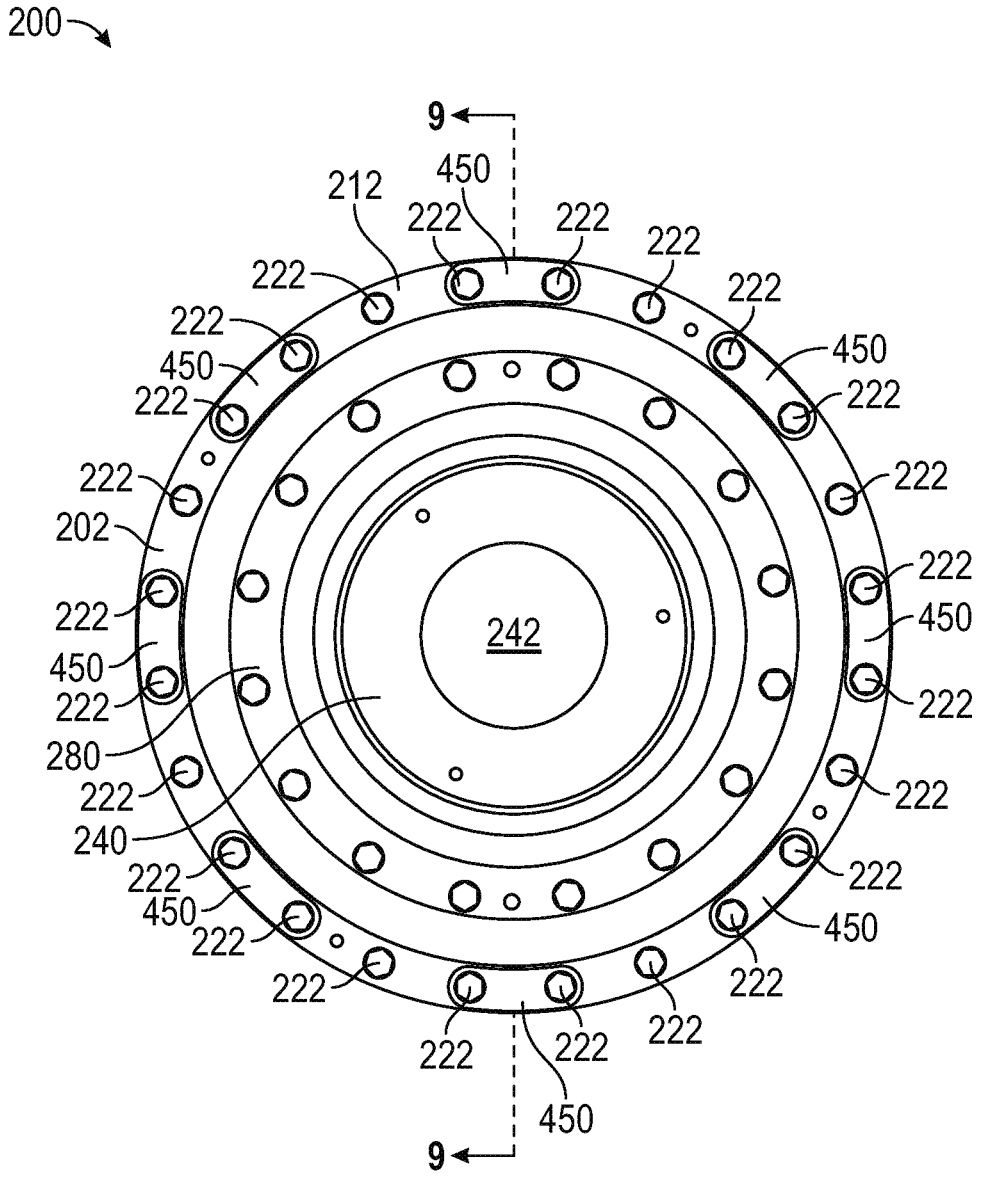
FIG. 8 is a side view of the spherical coupling assembly shown in FIG. 7.
Figure 9:
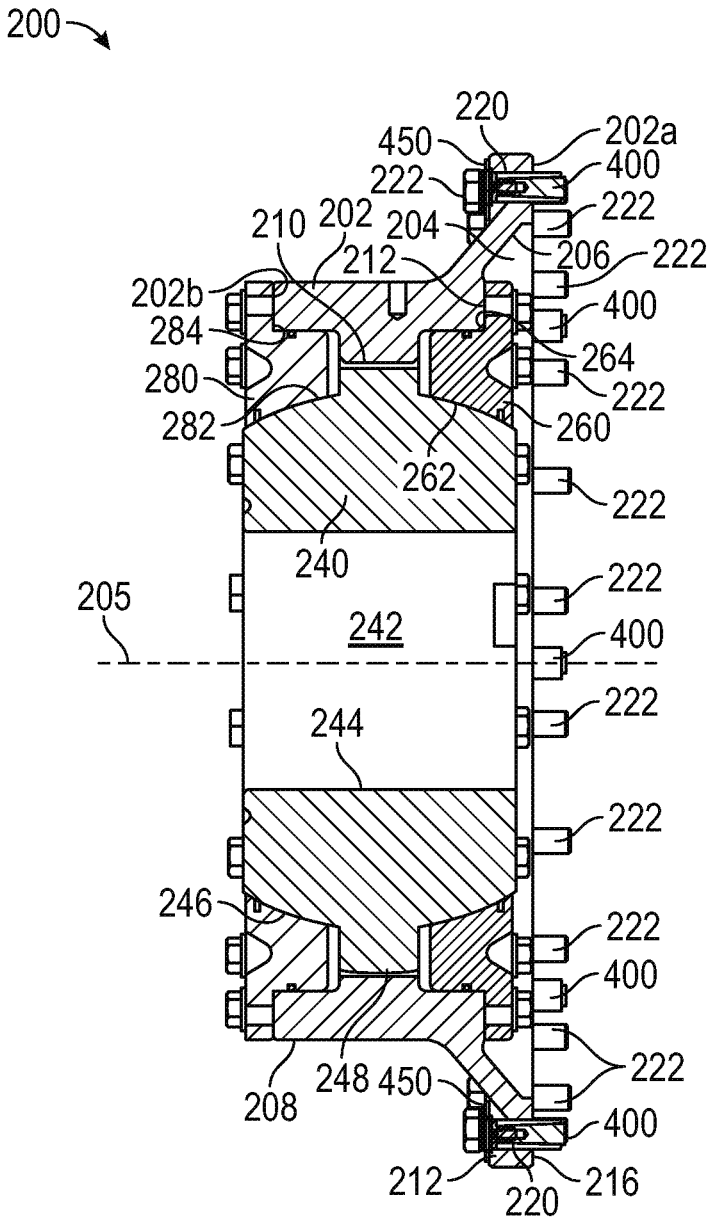
FIG. 9 is a cross-sectional view along line 9-9 of FIG. 8 of the spherical coupling assembly shown in FIG. 7.

Referring to FIGS. 5 and 6, an embodiment of drum 120 of drawworks 100 is shown. In the embodiment shown in FIGS. 5 and 6, drum 120 is generally cylindrical and includes a central or longitudinal axis 125, a first longitudinal end **120*a*, a second longitudinal end 120*b* axially spaced from first end 120*a*, a central bore or passage 122 extending between ends 120*a*, 120*b*, and defined by a generally cylindrical inner surface 124, and an outer surface 126 extending between longitudinal ends 120*a* and 120*b*. When drum 120 is coupled with spherical coupling assembly 200 and cradle assembly 300 (shown in FIGS. 2-4), the longitudinal axis 125 is disposed substantially coaxial with longitudinal axis 105 of drawworks assembly 100. The outer surface 126 of drum 120 includes a pair of radially outwards extending flanges 128 disposed proximal longitudinal ends 120*a* and 120*b*, and a groove 130 extending between flanges 128. In certain embodiments, groove 130 comprises a Lebus groove configured to prevent snagging of drilling line 29 during spooling and/or unspooling of line 29**.

In this embodiment, each longitudinal end **120*a* of drum 120 includes a radially inner engagement surface 132 and a radially outer engagement surface 134 radially spaced from inner engagement surface 132. In some embodiments, radially inner engagement surface 132 comprises a planar and/or inner engagement surface 132. Inner engagement surface 132 of drum 120 extends radially outwards from inner surface 124 while outer engagement surface 134 extends radially inwards from outer surface 126. Inner engagement surface 132 disposed at first end 120*a* is configured to matingly engage and releasably couple with a corresponding engagement surface of spherical coupling assembly 200 while the inner engagement surface 132 disposed at second end 120*b* is configured to matingly engage and releasably couple with a corresponding engagement surface of cradle assembly 300, as will be discussed further herein. In this embodiment, inner engagement surfaces 132 each comprise annular planar surfaces disposed orthogonal longitudinal axis 125 of drum 120. In other words, a diameter of each planar inner engagement surface 132 orthogonally intersects longitudinal axis 125. Similarly, outer engagement surfaces 134 each comprise annular planar surfaces disposed orthogonal longitudinal axis 125**.

In this embodiment, each inner engagement surface 132 of drum 120 includes a first plurality of circumferentially spaced threaded apertures 138 and a first plurality of circumferentially spaced unthreaded apertures 140 extending therein, where threaded apertures 138 and unthreaded apertures 140 are disposed along a common circumference. Additionally, each threaded aperture 138 and unthreaded aperture 140 extends along an axis disposed substantially parallel with longitudinal axis 125 and orthogonal inner engagement surface 132. As will be discussed further herein, each threaded fastener 138 is configured to receive a corresponding threaded fastener while each unthreaded aperture 140 is configured to receive a corresponding unthreaded fastener or shear pin assembly. As shown particularly in FIG. 5, each unthreaded aperture 140 is disposed circumferentially between a pair of flanking threaded apertures 138. As shown particularly in FIG. 6, each unthreaded aperture 140 includes a first or outer bore 142 and a second or inner bore 144 where outer bore 142 extends axially into inner engagement surface 132 from a longitudinal end of drum 120 (either first end 120*a* or second end 120*b*) and inner bore 144 extends further axially into engagement surface 132 from a terminal end of outer bore 142. In this configuration, outer bore 142 comprises a diameter that is greater than a diameter of inner bore 144. Additionally, in this embodiment the diameter of the outer bore 142 of each unthreaded aperture 140 is greater than a diameter of each threaded aperture 138.

Each outer engagement surface 134 of drum 120 also includes a second plurality of circumferentially spaced threaded apertures 138 and a second plurality of unthreaded apertures 140 extending axially therein, with the second plurality of threaded apertures 138 and the second plurality of unthreaded apertures 140 disposed along a common circumference. In addition, each unthreaded aperture 140 of the second plurality is flanked circumferentially by a pair of threaded apertures 138, similar to the arrangement of apertures 138 and 140 on inner engagement surfaces 132. Although in the embodiment shown in FIGS. 5 and 6 includes second pluralities of threaded apertures 138 and unthreaded apertures 140 extending in each outer engagement surface 134, in other embodiments, outer engagement surface 134 may not include apertures 138 and 140. In this embodiment, each outer engagement surface 134 is configured to matingly engage and releasably couple with a corresponding disk brake 114. In certain embodiments, drum 120 may not include outer engagement surface 134, such as in embodiments of drawworks 100 that do not include disk brakes 114.

Referring to FIGS. 7-10, an embodiment of spherical coupling assembly 200 is shown. As described above, spherical coupling assembly 200 is generally configured to transmit torque from gearbox 110 to drum 120 via driveshaft 112. In the embodiment shown in FIGS. 7-9, spherical coupling assembly 200 generally includes an annular outer hub or body 202, an annular spherical coupler 240, a first or inner annular connecting flange 260, and a second or outer annular connecting flange 280. Spherical coupler 240 is configured to receive torque from driveshaft 112 and transmit the received torque to hub 202 via a splined connection interface disposed radially therebetween while connecting flanges 260 and 280 are configured to restrict relative axial movement and thereby secure spherical coupling 240 to hub 202.

In this embodiment, hub 202 has a central or longitudinal axis 205, a first or longitudinally inner end 202*a*, a second or longitudinally outer end 202*b*, a central bore 204 extending between ends 202*a*, 202*b*, and defined by an inner surface 206, and an outer surface 208 extending between ends 202*a* and 202*b*. As shown particularly in FIG. 9, the inner surface 206 of hub 202 includes a plurality of circumferentially spaced splines 210 extending radially inwards therefrom for engaging a corresponding plurality of splines of spherical coupler 240. Inner surface 206 additionally includes a radially extending annular flange 212 for matingly engaging and releasably coupling with inner connecting flange 260. The outer surface 208 of hub 202 includes a radially outwards extending flange 214 disposed at inner longitudinal end 202*a*. As shown particularly in FIGS. 9 and 10, the longitudinally inner end 202*a* of hub 202 comprises an annular engagement surface 216 configured to matingly engage and releasably couple with the inner engagement surface 132 of the first end 120*a* of drum 120. In this embodiment, engagement surface 216 comprises a planar surface disposed orthogonal longitudinal axis 205 of hub 202. In other words, a diameter of planar engagement surface 216 orthogonally intersects longitudinal axis 205 of hub 202.

Figure 10:
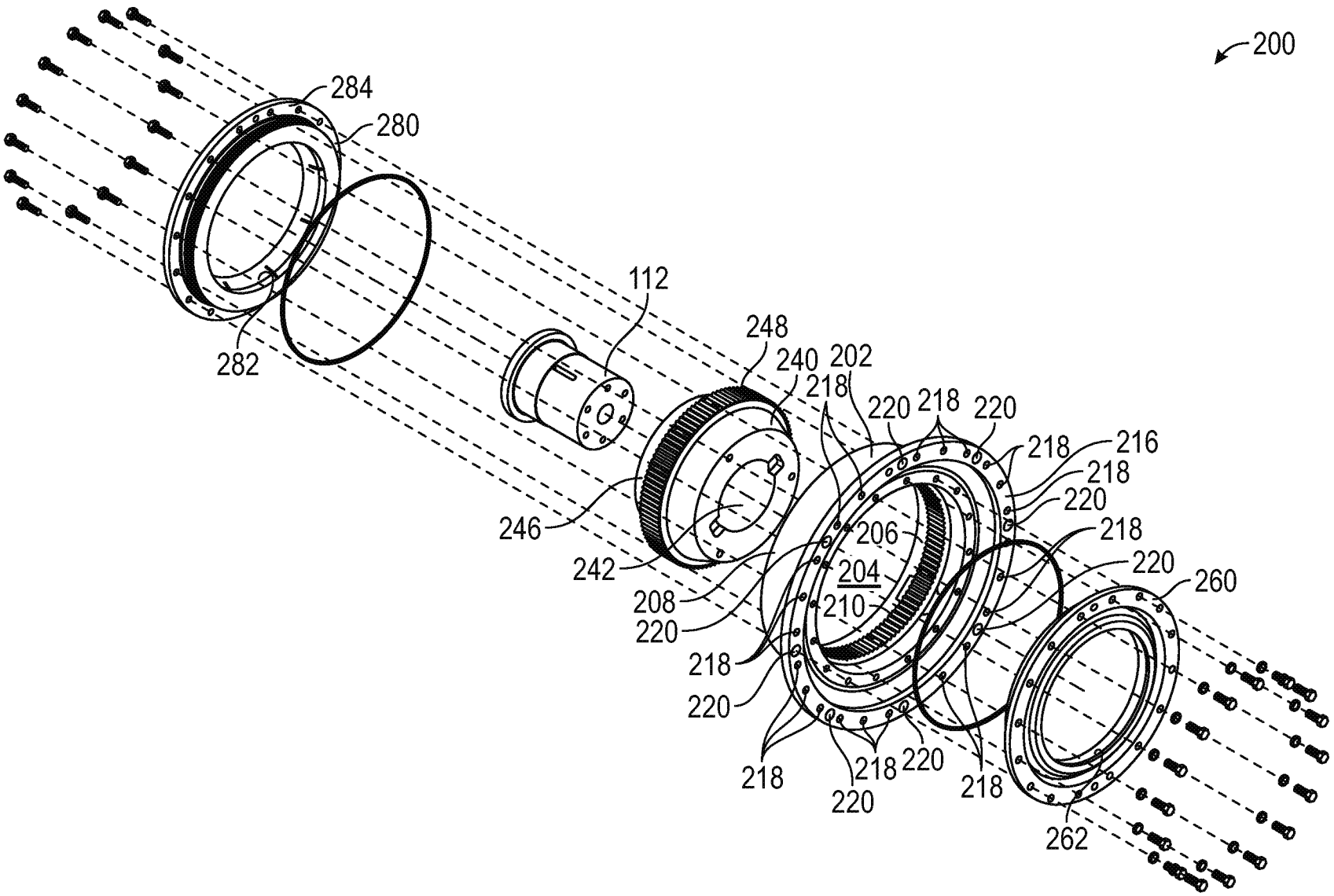
FIG. 10 is an exploded, perspective view of the spherical coupling assembly shown in FIG. 7.

As shown particularly in FIG. 10, engagement surface 216 of hub 202 includes a plurality of circumferentially spaced first apertures 218 and a plurality of circumferentially spaced second apertures 220, where first apertures 218 and second apertures 220 are disposed along a common circumference. Particularly, the circumference upon which apertures 218 and 220 are disposed comprises a diameter that is equal in size to a diameter of the circumference on which apertures 138 and 140 of drum 120 are disposed. Additionally, each first aperture 218 and second aperture 220 extends along an axis disposed substantially parallel with longitudinal axis 205 and orthogonal engagement surface 216. Further, each second aperture 220 is disposed circumferentially between a pair of flanking first apertures 218. In this arrangement, when the longitudinal axis 205 of hub 202 and the longitudinal axis 125 of drum 120 are aligned, and apertures 218 and 220 of hub 202 are circumferentially aligned with apertures 138 and 140 of drum 120, apertures 218 and 220 of hub 202 are aligned with apertures 138 and 140 of drum 120, allowing for the passage of a fastener or pin through corresponding pairs of apertures 138 and 218, and apertures 140 and 220.

Moreover, in this embodiment each first aperture 218 of hub 202 comprises a diameter that is similar in size to the diameter of each threaded aperture 138 of drum 120, and each second aperture 220 of hub 202 comprises a diameter that is similar in size to the diameter of each unthreaded aperture 140. However, in other embodiments the diameter of each first aperture 218 may vary from the diameter of each threaded aperture 138, and the diameter of each second aperture 220 may vary from the diameter of each unthreaded aperture 220. As will be discussed further herein, first apertures 218 are configured to receive threaded fasteners 222 while second apertures 220 are configured to release pin assemblies 400, where fasteners 222 and pin assemblies 400 are configured to releasably couple spherical coupling assembly 200 with drum 120. In certain embodiments, a washer is used in conjunction with each threaded fastener to distribute loads from the fastener 222.

In the embodiment shown in FIGS. 7-10, spherical coupler 240 generally includes a bore 242 defined by a generally cylindrical inner surface 244, and a curved or hemispherical outer surface 246. The inner surface 244 of coupler 240 includes a groove or slot for receiving a corresponding spline of driveshaft 112 to restrict relative rotation between driveshaft 112 and coupler 240 and thereby allow for the transmission of torque between gearbox 110 and spherical coupling assembly 200. The curved outer surface 246 of spherical coupler 240 includes a plurality of circumferentially spaced splines 248 extending radially outwards therefrom, where splines 248 are configured to matingly engage the circumferentially spaced splines 210 of hub 202 to thereby provide for the transmission of torque between spherical coupler 240 and hub 202. Inner connecting flange 260 includes a curved or partially spherical inner surface 262 and a radially extending engagement interface 264 configured to matingly engage and releasably couple with flange 212 of hub 202 via a plurality of circumferentially spaced fasteners. Similarly, outer connecting flange 280 includes a curved or partially spherical inner surface 282 and a radially extending engagement interface 284 configured to matingly engage and releasably couple with the longitudinally outer end 202*b* of hub 202 via a plurality of circumferentially spaced fasteners. In this arrangement, connecting flanges 260 and 280 secure spherical connector 240 within hub 202 while allowing for angular misalignment between the longitudinal axis 205 of hub 202 and a longitudinal axis of spherical coupler 240. In this manner, hub 202 may be rotated and torque may be transmitted from coupler 240 to hub 202 even when the longitudinal axis 205 of hub 202 and the longitudinal axis of coupler 240 are angularly misaligned.

Referring to FIGS. 12-15, an embodiment of cradle assembly 300 is shown. In this embodiment, cradle assembly 300 generally includes a support frame 302, a housing 310, a bearing assembly 320, and an annular hub 360. Support frame 302 is configured to assist in physically supporting drum 120 and is coupled to support frame 102 (shown in FIGS. 2-4) of drawworks assembly 100. Housing 310 is supported on frame 302 and houses and supports bearing assembly 320, where bearing assembly 320 is configured to provide for relative rotation between hub 360 and the housing 310 and support frame 302. Particularly, bearing assembly 320 is disposed within a chamber 312 of housing 310 and generally includes a plurality of roller bearings 322 disposed radially between a radially outer annular bearing race 324 and a radially inner annular bearing race 326, where relative rotation is permitted between bearing races 324 and 326 via roller bearings 322. In this embodiment, roller bearings 322 are inclined or angled relative a longitudinal axis 345 of hub 340 to provide support both radial and axial or thrust loads applied against hub 340 of cradle assembly 300.

In the embodiment shown in FIGS. 12-15, hub 340 of cradle assembly 300 is configured to releasably couple with the second longitudinal end 120*b* of drum 120 and generally includes a first or longitudinally inner end 340*a*, a second or longitudinally outer end 340*b*, a central bore 342 extending between ends 340*a*, 340*b* and defined by an inner surface 344, and an outer surface 346 extending between ends 340*a* and 340*b*. The outer surface 346 of hub 340 couples with the radially inner bearing race 326 of bearing assembly 320 proximal longitudinal outer end 340*b* to couple hub 340 with bearing assembly 320. Outer surface 346 includes a radially outwards extending flange 348 disposed proximal inner longitudinal end 340*a*. As shown particularly in FIG. 13, the longitudinally inner end 340*a* of hub 340 comprises an annular engagement surface 350 configured to matingly engage and releasably couple with the inner engagement surface 132 of the second end 120*b* of drum 120. In this embodiment, engagement surface 350 comprises a planar surface disposed orthogonal longitudinal axis 345 of hub 340. In other words, a diameter of planar engagement surface 350 orthogonally intersects longitudinal axis 345 of hub 340.

Figure 13:
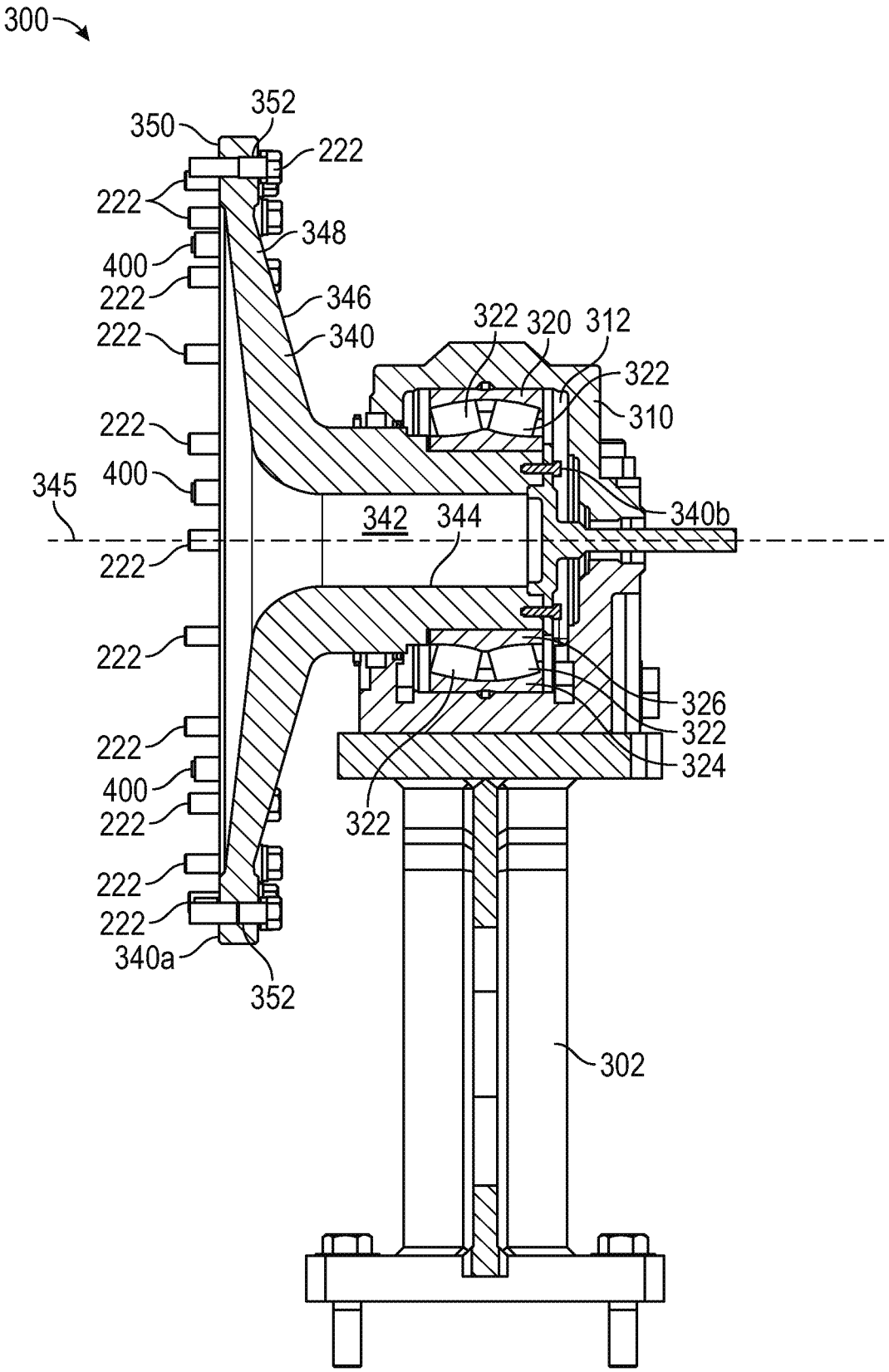
FIG. 13 is a cross-sectional view alone line 13-13 of FIG. 12 of the cradle assembly shown in FIG. 12.
Figure 14:
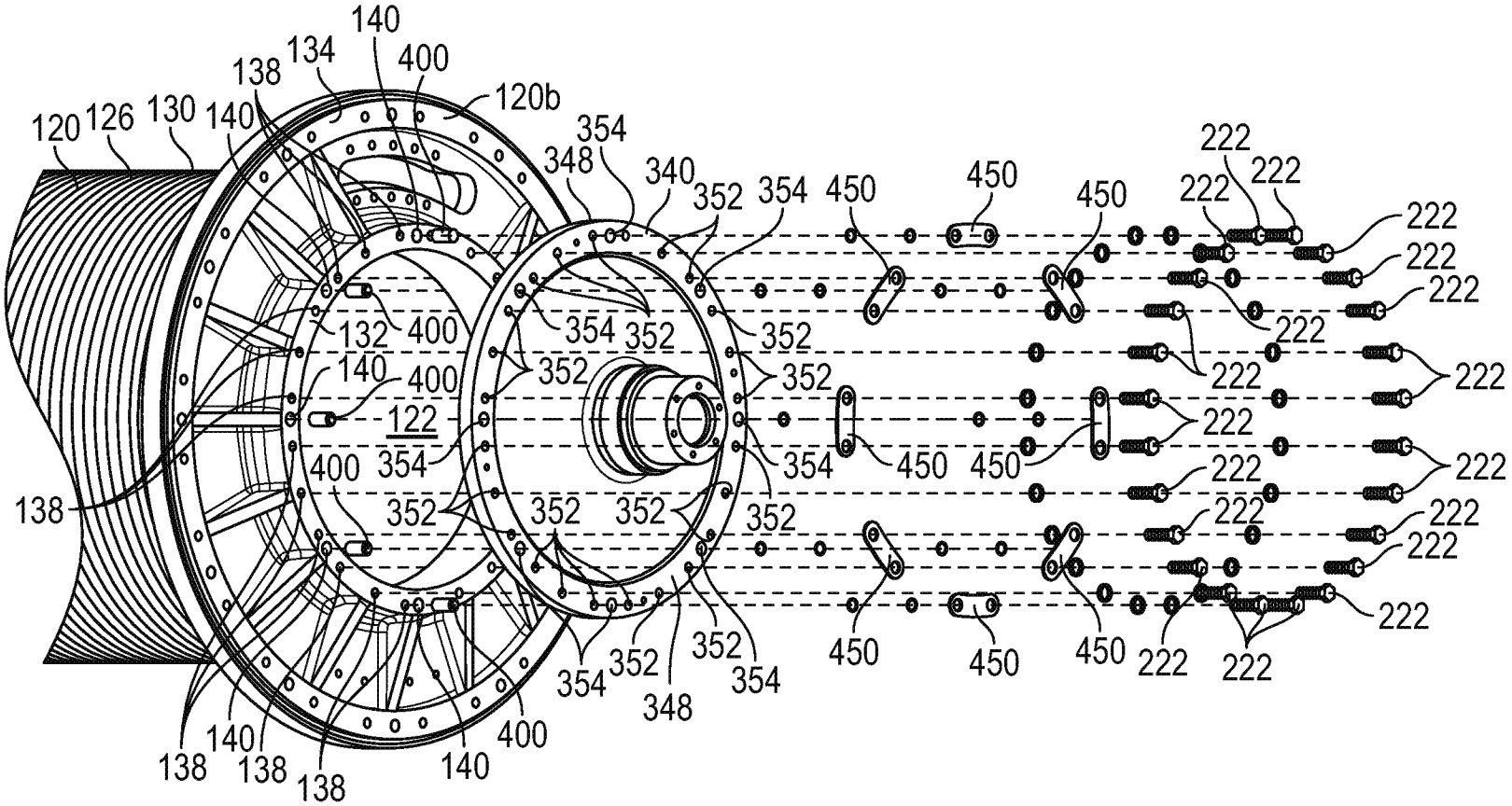
FIG. 14 is an exploded, perspective view of a hub of the cradle assembly shown in FIG. 12.

As shown particularly in FIGS. 13 and 14, engagement surface 350 of hub 340 includes a plurality of circumferentially spaced first apertures 352 and a plurality of circumferentially spaced second apertures 354, where first apertures 352 and second apertures 354 are disposed along a common circumference. Particularly, the circumference upon which apertures 352 and 354 are disposed comprises a diameter that is equal in size to a diameter of the circumference on which apertures 138 and 140 of drum 120 are disposed. Additionally, each first aperture 352 and second aperture 354 extends along an axis disposed substantially parallel with longitudinal axis 345 and orthogonal engagement surface 350. Additionally, each second aperture 354 is disposed circumferentially between a pair of flanking first apertures 352. In this arrangement, when the longitudinal axis 345 of hub 340 and the longitudinal axis 125 of drum 120 are aligned and apertures 352 and 354 of hub 340 are circumferentially aligned with apertures 138 and 140 of drum 120, apertures 352 and 354 of hub 340 are axially aligned with apertures 138 and 140 disposed at the second end 120*b* of drum 120, allowing for the passage of a fastener or pin through corresponding pairs of apertures 138 and 352, and apertures 140 and 354.

Moreover, in this embodiment each first aperture 352 of hub 340 comprises a diameter that is similar in size to the diameter of each threaded aperture 138, and each second aperture 354 of hub 340 comprises a diameter that is similar in size to the diameter of each unthreaded aperture 140. However, in other embodiments the diameter of each first aperture 352 may vary from the diameter of each threaded aperture 138, and the diameter of each second aperture 354 may vary from the diameter of each unthreaded aperture 354. Further, first apertures 352 are configured to receive threaded fasteners 222 (along with a washer in this embodiment) while second apertures 354 are configured to release pin assemblies 400 to releasably couple hub 340 and cradle assembly 300 with drum 120.

Figure 11:
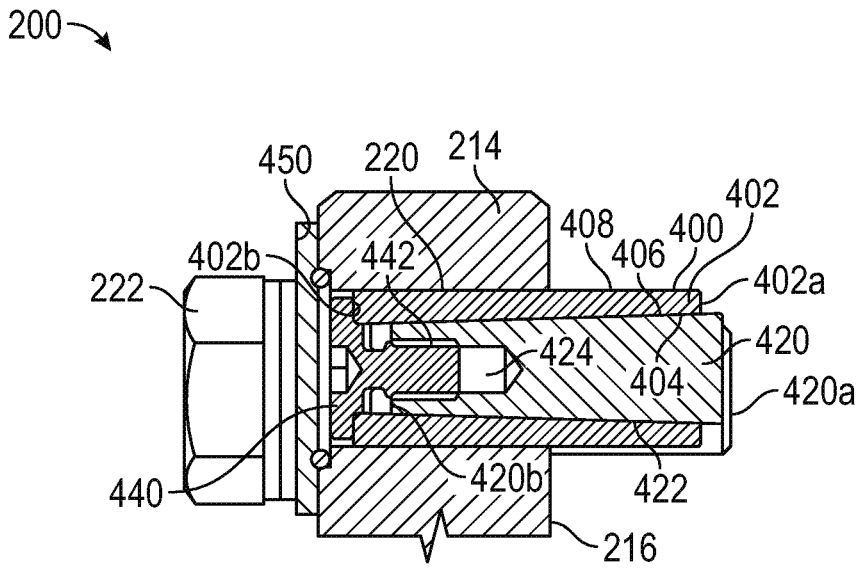
FIG. 11 is a zoomed-in, cross-sectional view along line 9-9 of FIG. 8 of an embodiment of a fastener assembly of the spherical coupling assembly shown in FIG. 7 in accordance with principles disclosed herein.
Figure 12:
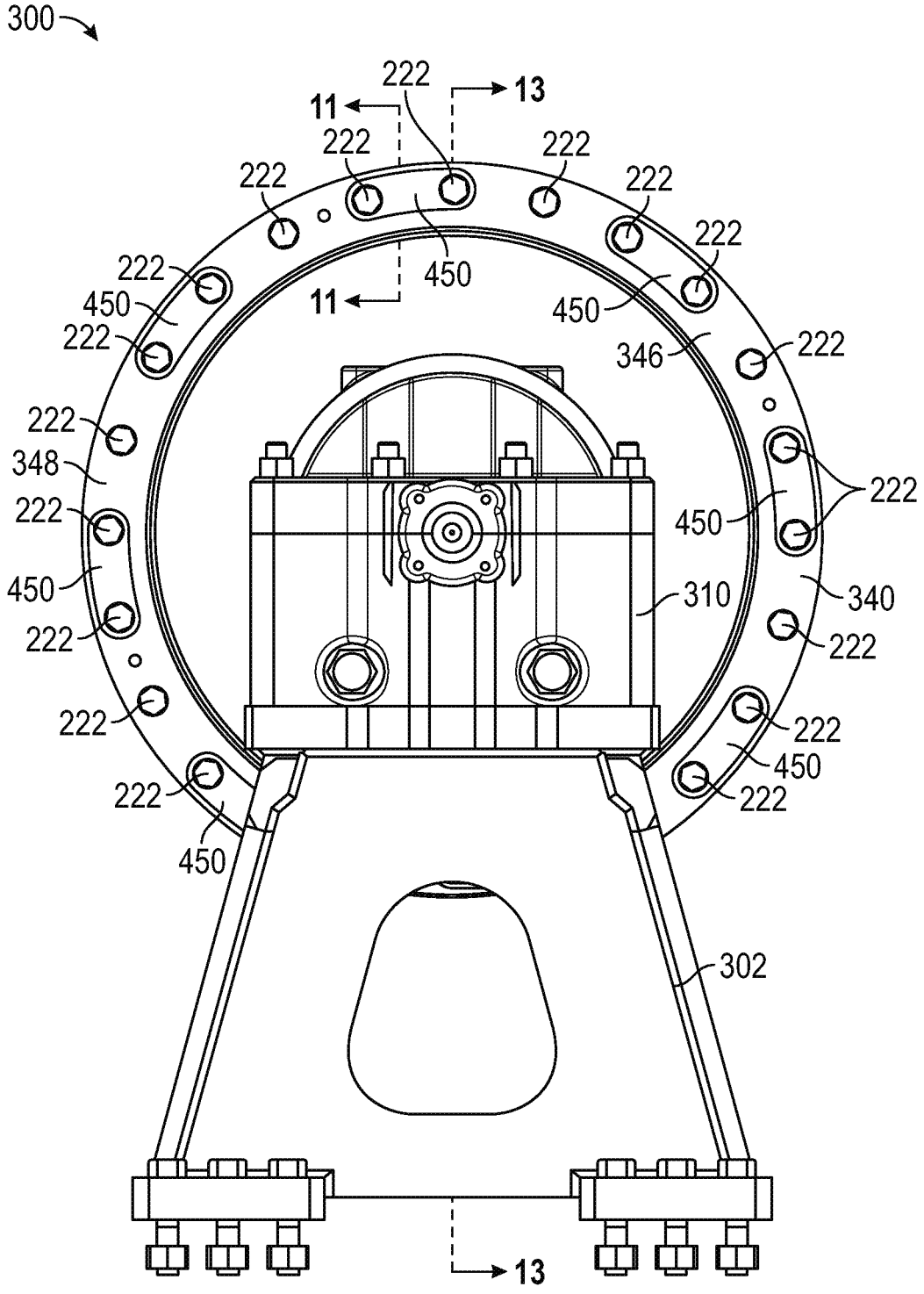
FIG. 12 is a side view of an embodiment of a cradle assembly of the drawworks assembly shown in FIG. 2 in accordance with principles disclosed herein.
Figure 15:
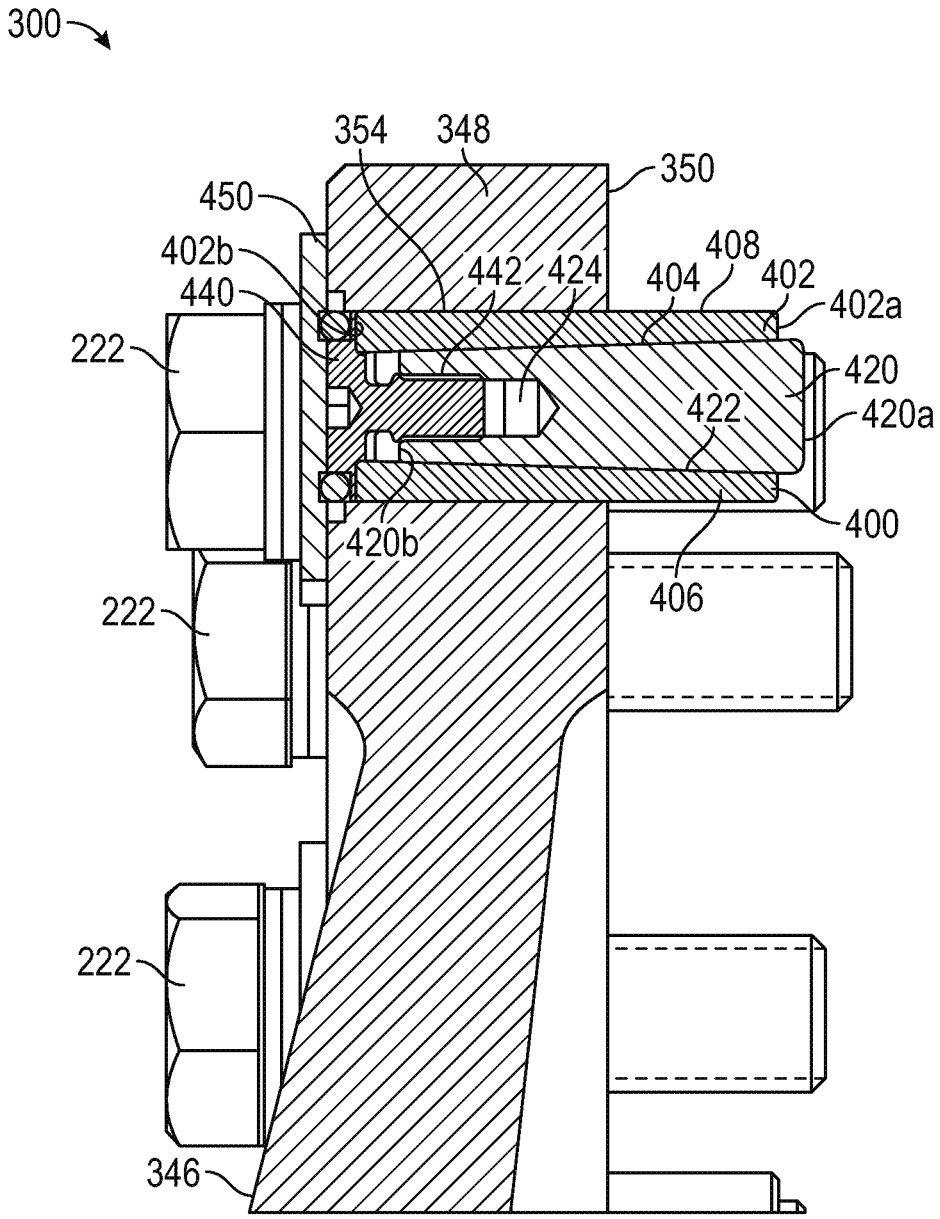
FIG. 15 is a cross-sectional view alone line 14-14 of FIG. 12 of an embodiment of a fastener assembly of the cradle assembly shown in FIG. 12.

Referring to FIGS. 8, 11, 12 and 15, cross-sectional views of an embodiment of pin assembly 400 are shown. Particularly, FIG. 11 illustrates a pin assembly 400 disposed in a second aperture 220 of the hub 202 of spherical coupling assembly 200 while FIG. 15 illustrates a pin assembly 400 disposed in a second aperture 354 of the hub 340 of cradle assembly 300. In the embodiment shown in FIGS. 11 and 15, each pin assembly 400 generally includes an outer sleeve 402, a generally cylindrical pin 420 at least partially disposed in the sleeve 402, and a threaded fastener 440 at least partially disposed in an aperture of the pin 420. As shown particularly in FIGS. 8 and 12, an arcuate cover plate 450 extends over a longitudinally outer end of each pin assembly 400, where each cover plate 450 is secured into position via a pair of threaded fasteners 222 circumferentially flanking the pin assembly 400. In some embodiments, cover plates 450 may be used to prevent debris or particulates from entering the second apertures 220 of hub 202 and/or the second apertures 354 of hub 340. In some embodiments, a seal may be disposed longitudinally between cover plate 450 and the radially outer end of the corresponding pin assembly 400 to assist in preventing debris from entering apertures 220 and/or 354. Outer sleeve 402 of pin assembly 400 has a first or longitudinally inner end 402*a*, a second or longitudinally outer end 402*b*, a central bore 404 extending between ends 402*a*, 402*b* and defined by a generally cylindrical inner surface 406, and an outer surface 408 extending between ends 402*a* and 420*b*. In some embodiment, sleeve 402 comprises a c-ring including a slot extending between ends 402*a* and 402*b* to allow for the radial expansion and/or contraction of bore 404.

In this embodiment, pin 420 of pin assembly 400 generally includes a first or longitudinally inner end 420*a*, a second or longitudinally outer end 420*b*, and a generally cylindrical outer surface 422 extending between ends 420*a* and 420*b*. In addition, pin 420 includes an aperture 424 extending longitudinally into second end 420*b*, where aperture 424 includes a threaded inner surface. Fastener 440 includes a threaded outer surface 442 for threadably connecting with the threaded inner surface of the aperture 424 of pin 420. In this arrangement, rotation of fastener 440 (e.g., via the application of a tool, etc.) results in longitudinal displacement of pin 420 through the bore 404 of sleeve 402. Further, bore 404 of sleeve 402 increases in diameter moving from inner end 402*a* to outer end 402*b* while the outer surface 422 of pin 420 decreases in diameter moving from inner end 420*a* to outer end 420*b*. In other words, the outer surface 422 of pin 420 comprises a frustoconical surface that varies in diameter along the longitudinal length of pin 420.

In this configuration, longitudinal displacement of pin 420 in a first direction towards the outer end 402*b* of sleeve 402 results in an increase in the diameter of bore 404 and the outer surface 408 of sleeve 402 as the larger diameter section of the outer surface 422 of pin 420 disposed proximal inner end 420*a* enters the bore 404 of sleeve 402, forcing sleeve 402 to expand radially outwards. Conversely, longitudinal displacement of pin 420 in a second direction towards the inner end 402*a* of sleeve 402 results in a decrease in the diameter of bore 404 and the outer surface 408 of sleeve 402 as the larger diameter section of outer surface 422 is displaced from the bore 404 of sleeve 402. In this manner, the diameter of the outer surface 408 of sleeve 402 may be adjusted via the longitudinal displacement of pin 420 within bore 404, which is controlled by rotation of fastener 440.

Referring to FIGS. 2, 3, 5, 6, 9, 11, 13, 15, and 16, when drawworks assembly 100 is disposed in an assembled position shown in FIGS. 2 and 3, a pin assembly 400 is received in each unthreaded aperture 140 and a threaded fastener 222 is received in each threaded aperture 138 to releasably couple drum 120 to both spherical coupling assembly 200 and cradle assembly 300. In this position, torque may be transmitted from gearbox 110 to drum 120 via spherical coupling assembly 200. In particular, torque applied to spherical coupling assembly 200 is transmitted to drum 120 via the plurality of threaded fasteners 222 and pin assemblies 400 extending between each corresponding pair of first apertures 218 and threaded apertures 138 for threaded fasteners 222, and second apertures 220 and unthreaded apertures 140 for pin assemblies 400. Particularly, fasteners 222 and pin assemblies 400 transmit torque to drum 120 via a shear force applied to each fastener 222 and assembly 400.

In this embodiment, pin assemblies 400 comprise a larger diameter and cross-sectional area than fasteners 222, increasing the amount of shear force that may be applied to each assembly 400 and thereby allowing each pin assembly 400 to transmit a greater amount of torque to drum 120 from gearbox 110. Moreover, each threaded fastener 222, when it is threadably connected with drum 120, is placed under tension, reducing the amount of shear force that may be applied to each fastener 222 before failure. Given that pin assemblies 400 are not threadably coupled to drum 120, assemblies 400 are not placed under a tension load, freeing them to absorb more shear load when applying torque to drum 120. Therefore, the inclusion of pin assemblies 400 reduces the overall number of fasteners and/or pins required to releasably couple drum 120 with spherical coupling assembly 200 and cradle assembly 300 and transmit torque between gearbox 110 and drum 120. The reduced number of fasteners provided for by pin assemblies 400 allows for the diameter of each inner engagement surface 132 to be reduced, thereby reducing the necessary diameter or size of drum 120. Moreover, the reduction of fasteners provided by pin assemblies 400 reduces the amount of time required to couple or decouple drum 120 from drawworks assembly 100.

In the arrangement described above, a pair of annular, lateral or orthogonal coupling interfaces 146 (shown in FIG. 4) are formed between drum 120 and the spherical coupling assembly 200 and cradle assembly 300, where drum 120 is releasably coupled to spherical coupling assembly 200 at a first interface 146 and drum 120 is releasably coupled to cradle assembly 300 at a second interface 146. In certain embodiments, coupling interfaces 146 comprise planar and/or annular engagement interfaces 146. A first annular coupling interface 146 is formed between the inner engagement surface 132 of drum 120 at first end 120*a* and the engagement surface 216 of the hub 202 of spherical coupling assembly 200, and a first annular coupling interface 146 is formed between the engagement surface 132 of drum 120 at second end 120*b* and the engagement surface 350 of the hub 340 of cradle assembly 300. Each annular interface 146 is disposed orthogonal the longitudinal axis 125 of drum 120. In other words, the diameter of each annular interface 146 intersects longitudinal axis 125 at a substantially normal or 90° angle.

Figure 16:
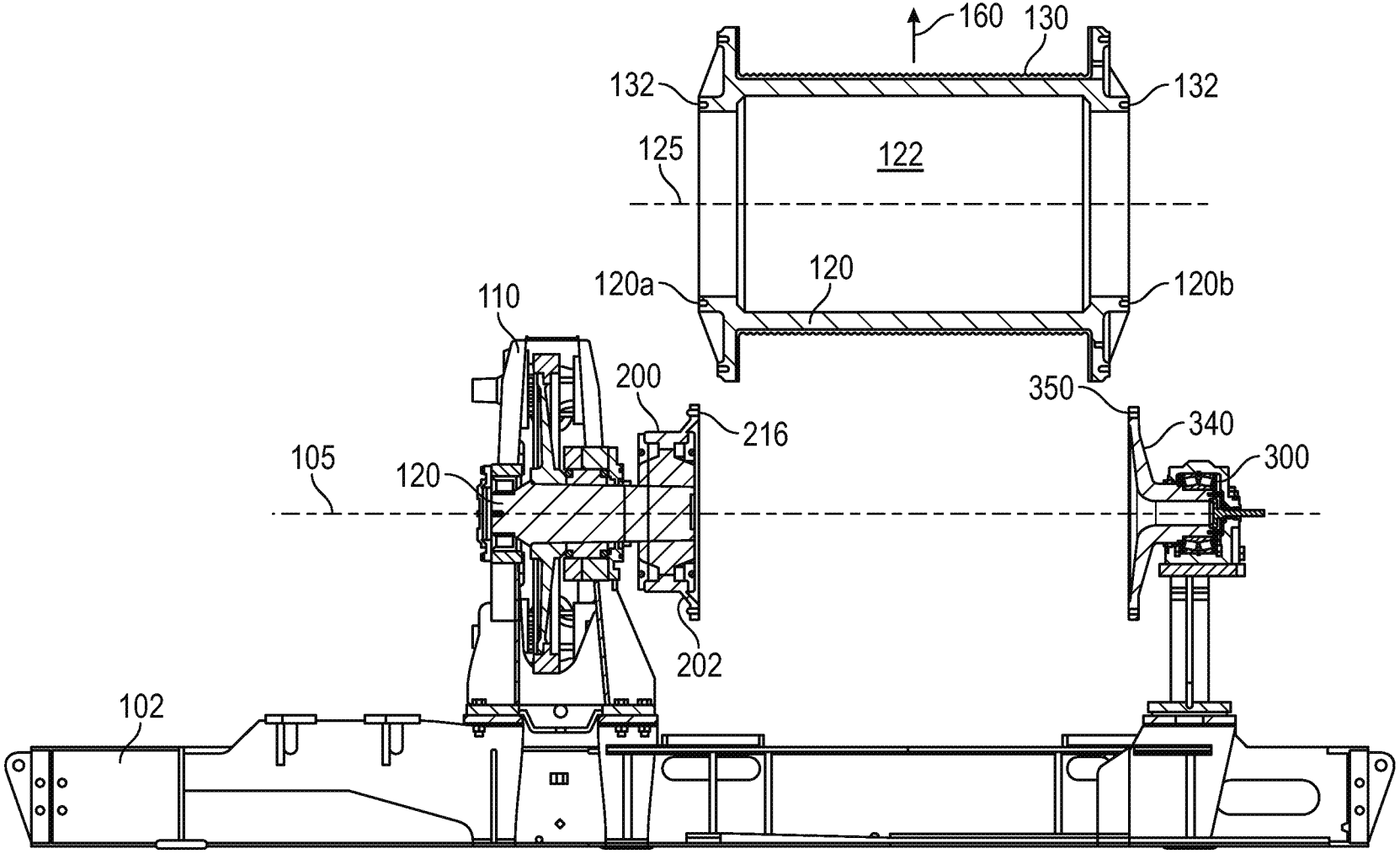
FIG. 16 is a side cross-sectional view of the drawworks assembly of FIG. 2 shown in a second position.

Given that drum 120 is releasably coupled to assemblies 200 and 300 of drawworks 100 at orthogonal coupling interfaces 146 instead of via a stub-shaft or other member extending into the bore 122 of drum 120, drum 120 may be removed from drawworks 100 without removing or otherwise displacing spherical coupling assembly 200 and cradle assembly 300. As shown particularly in FIG. 16, to remove drum 120 from drawworks 100 the threaded fasteners 222 and pin assemblies 400 are removed from each aperture 138 and 140, respectively, of drum 120, allowing for drum 120 to be displaced vertically (as indicated by arrow 160 in FIG. 16) with longitudinal axis 125 remaining parallel with the longitudinal axis 105 (i.e., parallel the ground and/or rig floor 12 shown in FIG. 1) or of drawworks assembly 100. During operation of drawworks 100, drum 120 may be removed to refurbish groove 130 or for other reasons. The ability to remove drum 120 via vertically lifting drum 120 as shown in FIG. 16 reduces the amount of time required for removing drum 120 from drawworks 100 by eliminating the need for decoupling spherical coupling assembly 200 and cradle assembly 300 from frame 102 such that assemblies 200 and 300 may be displaced or manipulated to provide sufficient room for removing drum 120. Moreover, as discussed above, the use of pin assemblies 400 decreases the total number of fasteners and/or pins required for coupling drum 120 to drawworks 100, further decreasing the time required for removing drum 120 from drawworks 100.

Following removal of drum 120 from drawworks 100, drum 120 may be reinstalled (or a new drum 120 may be installed in its place) by vertically lowering drum 120 with longitudinal axis 125 disposed parallel with longitudinal axis 105 of drawworks 100 until longitudinal axis 125 of drum 120 is disposed substantially coaxial with longitudinal axis 105 of drawworks assembly 100. Once drum 120 is substantially coaxially aligned with drawworks 100, drum 120 is rotated until threaded apertures 138 are circumferentially aligned with first apertures 218 and 352 of hub 202 and hub 340, respectively, and unthreaded apertures 140 are circumferentially aligned with second apertures 220 and 354 of hubs 202 and 340, respectively.

Following the circumferential alignment of drum 120 with hubs 202 and 340, pin assemblies 400 are inserted into their corresponding unthreaded apertures 140 of drum 120. In this arrangement, pin assemblies 400 disposed at the first end 120*a* of drum 120 extend across interface 146 and are received within both unthreaded apertures 140 of drum 120 and second apertures 220 of hub 202, restricting relative rotation between hub 202 and drum 120. Similarly, pin assemblies 400 disposed at the second end 120*b* of drum 120 extend across interface 146 and are received within both unthreaded apertures 140 of drum 120 and second apertures 354 of hub 340, restricting relative rotation between hub 340 and drum 120. Once pin assemblies 400 are received within unthreaded apertures 140, the fastener 440 of each assembly 400 may be rotated to longitudinally displace the corresponding pin 420 to adjust the diameter of sleeve 402. For instance, in some embodiments pin 420 of each assembly 400 may be retracted into the bore 404 of sleeve 402 to expand the diameter of sleeve 402 and pin assembly 400 to reduce or eliminate any "play" or clearance between the outer surface 408 of sleeve 402 and the inner surface of the unthreaded aperture 140. Once pin assemblies 400 are received within unthreaded apertures 140 of drum 120, threaded fasteners 222 (including cover plates 450) are threadably coupled to their corresponding threaded apertures 138 of drum 120, thereby releasably coupling drum 120 to spherical coupling assembly 200 and cradle assembly 300.

Thus, a method is provided for manipulating a drum (e.g., drum 120) of a drawworks assembly (e.g., drawworks assembly 120) that comprises removing a first plurality of fasteners (e.g., fasteners 222), releasably coupling a drum with a coupling assembly (e.g., spherical coupling assembly 200), removing a second plurality of fasteners (e.g., fasteners 222), releasably coupling the drum with a cradle assembly (e.g., cradle assembly 300), and lifting the drum vertically from the drawworks assembly. In certain embodiments, the method comprises vertically lowering the drum until a longitudinal axis of the drum is aligned with a longitudinal axis of the drawworks assembly, inserting the first plurality of fasteners into a plurality of circumferentially spaced apertures disposed in a first annular engagement surface of the drum to releasably couple the coupling assembly with the drum; and inserting the second plurality of fasteners into a plurality of circumferentially spaced apertures disposed in a second annular engagement surface of the drum to releasably couple the cradle assembly with the drum.

The above discussion is meant to be illustrative of the principles and various embodiments of the present disclosure. While certain embodiments have been shown and described, modifications thereof can be made by one skilled in the art without departing from the spirit and teachings of the disclosure. The embodiments described herein are exemplary only, and are not limiting. Accordingly, the scope of protection is not limited by the description set out above, but is only limited by the claims which follow, that scope including all equivalents of the subject matter of the claims.

What is claimed is:

1. A drawworks assembly, comprising:

a drum comprising a first end, a second end, and a longitudinal axis, wherein the first end of the drum comprises a first inner engagement surface, and wherein the second end of the drum comprises a second inner engagement surface;

a coupling assembly configured to transmit torque to the drum; and a cradle assembly configured to support the drum, wherein the coupling assembly is releasably coupled to the drum at a first planar engagement interface disposed at the first end of the drum, wherein the first planar engagement interface is formed between the first inner engagement surface of the drum and an engagement surface of a hub of the coupling assembly, wherein the cradle assembly is releasably coupled to the drum at a second planar engagement interface disposed at the second end of the drum, wherein the second planar engagement interface is formed between the second inner engagement surface of the drum and an engagement surface of a hub of the cradle assembly, wherein both the first and second inner engagement surfaces comprise a plurality of circumferentially spaced first apertures and a plurality of circumferentially spaced second apertures, wherein the drawworks assembly further comprises:

a plurality of circumferentially spaced fasteners extending through the hub of the coupling assembly, wherein each fastener threadably engages one of the plurality of circumferentially spaced first apertures to releasably couple the coupling assembly with the drum; and a plurality of circumferentially spaced pin assemblies extending through the hub of the coupling assembly, wherein each pin assembly is disposed in one of the plurality of second apertures to provide for the transmission of torque between the coupling assembly and the drum, wherein each pin assembly comprises:

an outer sleeve comprising a first end, a second end, and a bore extending between the first and second ends;

a pin disposed in the bore of the outer sleeve, wherein the pin comprises an outer surface having a diameter that varies across the longitudinal length of the pin; and a threaded fastener extending into an aperture of the pin, wherein rotation of the threaded fastener is configured to longitudinally displace the pin through the bore of the outer sleeve and adjust a diameter of an outer surface of the sleeve, and wherein a diameter of each pin assembly is greater than a diameter of each fastener.

2. The drawworks assembly of claim 1, wherein the first planar engagement interface and the second planar engagement interface are both disposed substantially orthogonal to the longitudinal axis of the drum.

3. The drawworks assembly of claim 1, wherein:

the drum comprises a bore extending between the first and second ends of the drum; and neither the coupling assembly nor the cradle assembly extend into the bore of the drum.

4. A drawworks assembly, comprising:

a drum comprising a first end, a second end, and a longitudinal axis, wherein the first end of the drum comprises a first inner engagement surface, and wherein the second end of the drum comprises a second inner engagement surface;

a coupling assembly configured to transmit torque to the drum; and a cradle assembly configured to support the drum;

wherein the coupling assembly is releasably coupled to the drum at a first planar engagement interface disposed at the first end of the drum, wherein the first planar engagement interface is formed between the first inner engagement surface of the drum and an engagement surface of a hub of the coupling assembly, wherein the cradle assembly is releasably coupled to the drum at a second planar engagement interface disposed at the second end of the drum, wherein the second planar engagement interface is formed between the second inner engagement surface of the drum and an engagement surface of a hub of the cradle assembly, wherein both the first and second inner engagement surfaces comprise a plurality of circumferentially spaced first apertures and a plurality of circumferentially spaced second apertures, wherein the first apertures and the second apertures are disposed along a common circumference such that each second aperture is disposed circumferentially between a pair of flanking first apertures, wherein the drawworks assembly further comprises:

a plurality of circumferentially spaced fasteners extending through the hub of the coupling assembly, wherein each fastener threadably engages one of the plurality of circumferentially spaced first apertures to releasably couple the coupling assembly with the drum; and a plurality of circumferentially spaced pin assemblies extending through the hub of the coupling assembly, wherein each pin assembly is disposed in one of the plurality of second apertures to provide for the transmission of torque between the coupling assembly and the drum, wherein each pin assembly comprises:

an outer sleeve comprising a first end, a second end, and a bore extending between the first and second ends;

a pin disposed in the bore of the outer sleeve, wherein the pin comprises an outer surface having a diameter that varies across the longitudinal length of the pin; and a threaded fastener extending into an aperture of the pin, wherein rotation of the threaded fastener is configured to longitudinally displace the pin through the bore of the outer sleeve and adjust a diameter of an outer surface of the sleeve, and wherein a diameter of each pin assembly is greater than a diameter of each fastener.

5. The drawworks assembly of claim 4, wherein the first planar engagement interface and the second planar engagement interface are both disposed substantially orthogonal to the longitudinal axis of the drum.

6. The drawworks assembly of claim 4, wherein:

the drum comprises a bore extending between the first and second ends of the drum; and neither the coupling assembly nor the cradle assembly extend into the bore of the drum.

* * * * *